US006175307B1

(12) United States Patent
Peterson

(10) Patent No.: US 6,175,307 B1
(45) Date of Patent: Jan. 16, 2001

(54) SECURITY SYSTEM WITH AUDIBLE LINK AND TWO-WAY COMMUNICATION

(75) Inventor: John Peterson, Downsview (CA)

(73) Assignee: Digital Security Controls Ltd., Concord ( * ) Notice: Under 35 U.S.C. 154(b), the term of this patent shall be extended for 0 days.

(21) Appl. No.: 08/819,769

(22) Filed: Mar. 18, 1997

(51) Int. Cl.[7] ..... G08B 1/00

(52) U.S. Cl. ..... 340/531; 340/506; 340/825.06; 340/825.31; 340/825.32; 379/39; 700/17

(58) Field of Search ..... 340/825.31, 825.32, 340/825.06, 539, 531, 541, 545.1, 545.2, 17; 379/95, 103, 104, 105, 39

(56) References Cited

U.S. PATENT DOCUMENTS 5,517,185 * 5/1996 Acimovic et al. ..... 340/825.31

FOREIGN PATENT DOCUMENTS 4324497 4/1994 (DE) .
WO 95 16980 6/1995 (WO) .

* cited by examiner

*Primary Examiner*—Daryl Pope

(57) ABSTRACT

The security system uses two-way audible type communication signals between a detector and a control panel. Each of these devices include microphones and processing arrangements for filtering the signals to recognize and evaluate the communication signals. The microphone of the control panel can preferably be part of an alarm detection and also part of a two-way voice communication with a monitoring station. This arrangement is convenient to install, reliable and cost effective.

8 Claims, 3 Drawing Sheets

SECURITY SYSTEM WITH AUDIBLE LINK AND TWO-WAY COMMUNICATION

FIELD OF THE INVENTION

The present invention relates to security systems and in particular is directed to a security system having a control panel and a combination keypad and door sensor.

BACKGROUND OF THE INVENTION

One of the issues with respect to security systems is the ease of installation of the system and the ability of the system to function easily in many different configurations. Most recently many security systems have used wireless sensors which at least transmit signals to a control panel using a radio frequency. Many of these systems use two-way communication between the sensors and the control panel. Two-way communication is very effective and reliable and the control panel can also carry out investigations to determine whether the sensors are active.

A more recent change in security systems is the ability to have a monitoring station carry out two-way communication with anyone located in the premises. It is now common for the monitoring station to announce that an alarm has been received and the police have been dispatched. A microphone allows anyone within the premise to respond and this microphone also allows the monitoring station to record the audible activity within the monitored space.

Security systems continued to evolve and glass break sensors are often provided in the security system. These sensors listen for a sound of breaking glass and produce an alarm when such a sound is detected.

The technology for effectively monitoring a given space is now quite well developed and the challenge often is being able to provide effective coverage at a reasonable cost.

SUMMARY OF THE INVENTION

A security system according to the present invention, comprised of a control panel and accommodation keypad and door sensor. The control panel includes an arrangement connected to a telephone system for communication with a monitoring station. The control panel includes a microphone, a single processing arrangement for the signal from the microphone, a microprocessor and a sound generating arrangement. A combination keypad and door sensor comprised of polarity of keys for entering codes into the keypad for arming and disarming the system, a microphone, a signal processing means for the signal of the microphone, a microprocessor and a sound generating arrangement. The control panel and the combination keypad and sensor use the sound generated in the microphones to form a high frequency communication link there between. The sound generator of the combination keypad and sensor produces a communication link part of the signal and high frequency range and produces an audible portion for the user indicating a requirement to enter information by the keypad. The control panel and the combination keypad and sensor interact to allow user to arm and disarm the system at the combination keypad and sensor and have the instructions communicated to the control panel by the two-way communication channel there between.

According to an aspect of the invention, the combination keypad and sensor also use the microphone as part of the sensing arrangement detecting other changes in the space being monitored.

According to a further aspect in the invention, the microphone and sound generating arrangement of the control panel is used by the control panel as part of the two-way communication channel with the monitoring station when an alarm condition has been communicated to the monitoring station.

A further aspect of the invention the control panel also processes the signal of its microphone for signals indicative of an alarm condition in the monitored space and thereby acts as a further sensor of the system.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
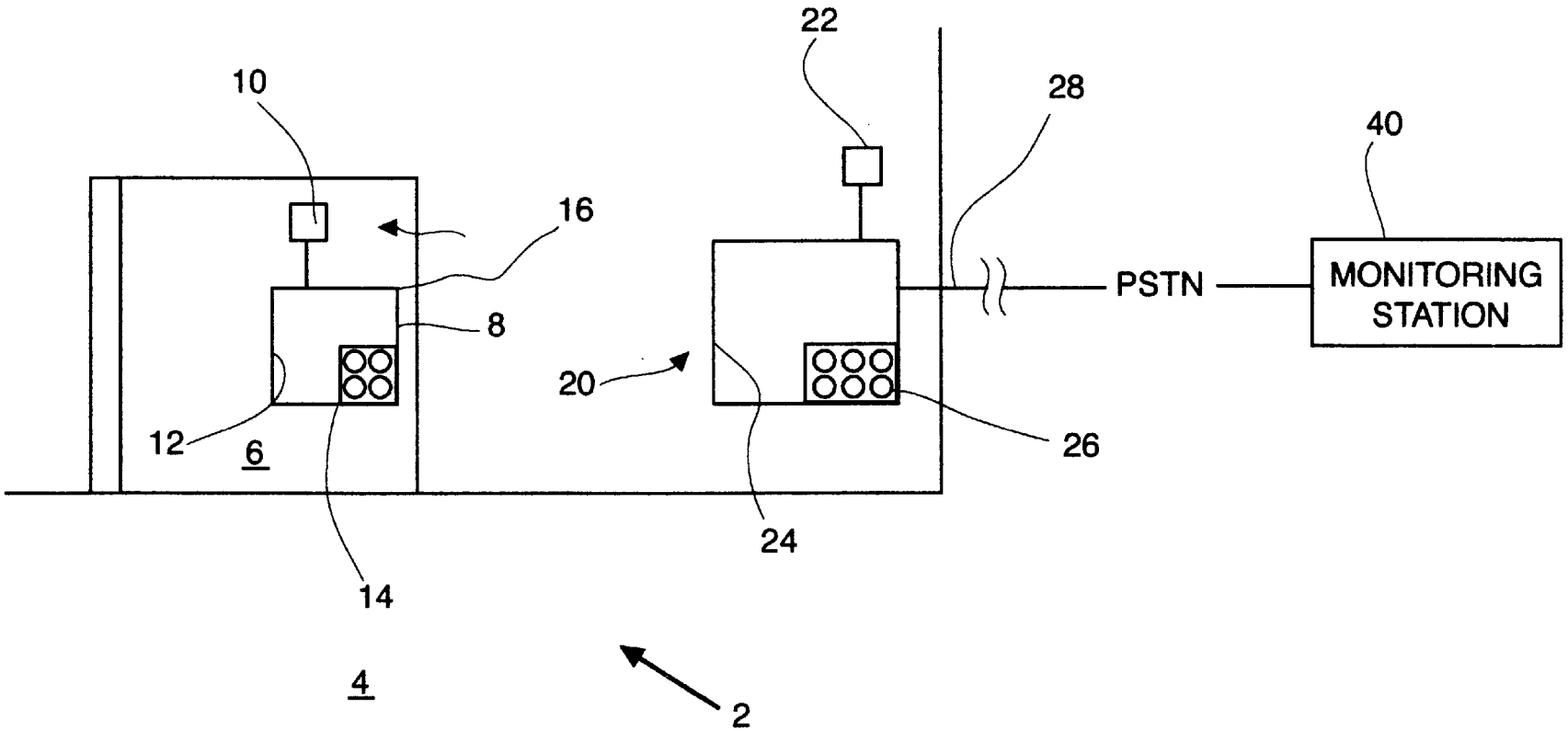
FIG. 1 is a schematic of the security system.

The security system 2 shown in FIG. 1 is particularly suitable for small premises such as condominiums and apartments. Typically these units have a single door 6 used for entering and leaving the premises. A combination unit 8 can be provided on the door 6 or immediately adjacent to door 6 which combination unit senses by the door sensing arrangement 16 the opening and closing of the door. The combination unit includes a microphone 10, a sound generator 12 and the keypad 14. This combination unit 8 is in two-way communication with the control panel 20. The control panel also includes a microphone 22, a sound generator 24, an optional keypad 26 and a communication arrangement 28 which communicates over the telephone lines to the monitoring station 40. As in existing security systems, the control panel upon detection of an alarm condition communicates to the monitoring station 40. Some security systems allow the monitoring station to use the sound generator of the control panel to report that the police have been dispatched. In addition, some of these control panels include a microphone for allowing the monitoring station to listen for a reply to any questions posed. In this way the monitoring station has a two-way communication link with the space being protected.

The combination unit 8 can also be used for detecting other events in the monitored space, such as detecting the sound of breaking glass.

Figure 2:
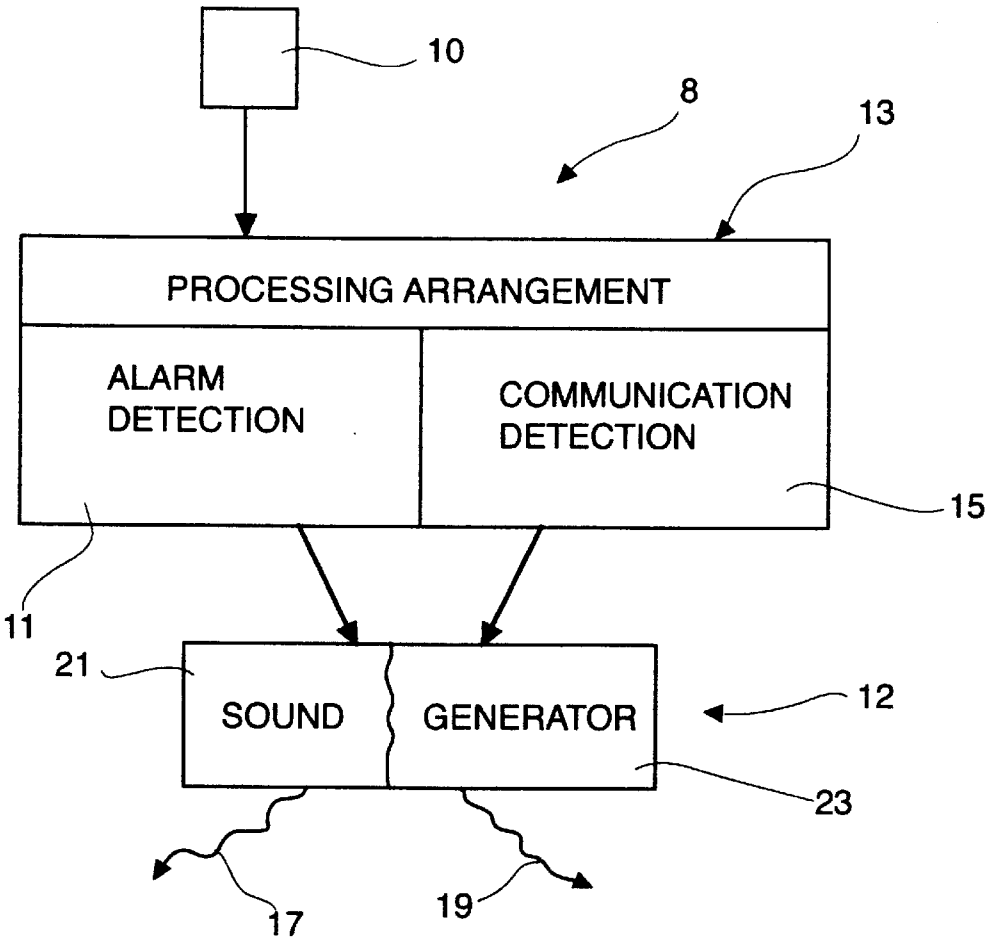
FIG. 2 is an overview of the operation of the combination keypad and sensor.

As shown in FIG. 2, the combination unit 8 processes the signal from the microphone 10 in two distinct manners. If the combination unit is also a glass break detector then detection for the glass break event is carried out by the processing arrangement 13 at 11 using various filtering steps to recognize a glass break event. If a glass break event is detected, an audible alarm type signal 17 is produced by the sound generator 12. In addition, the signal from microphone 10 is also processed for communications 39 from the control panel 20. Communication detection is indicated as 15 within the processing arrangement 13 The communication between the combination unit 8 and the control panel 20 is at high frequency near the upper audible range and therefore communication detection 15 includes of a relatively precise notch filter which limits the signal to a narrow high frequency band. The processing arrangement 13 analyzes this portion of the signal for information from the control panel.

The processing arrangement 13 also receives input from the keypad 14. Depending upon the various signals and the status of the system, the processing arrangement causes the sound generator 12 to produce two types of signals indicated as alarm type signal 17 and the communication signal 19. The alarm type signal 17 can indicate that the system is in alarm or about to go into alarm if the proper arming or disarming sequence is not finished. The communication signal 19 is a high frequency signal for reception by the control panel 20. The sound generator 12 has two distinct components. The first component 21 generates the audible signal indicating the status of the alarm system and the second component 23 produces the communication signal. Each of these components include a piezoelectric transducer. The signal 19 from component 23 is a high frequency signal and forms part of the audible link between the control panel and the combination unit 8. Preferably the signal is in the range of about 20,000 kHz and may sound like a fuzzy noise to an occupant. The benefit of this arrangement is that the microphones 10 and 22 are broadband microphones and the signals from the microphones are suitably processed for use in the communication link as well as use in a detection or alarm function. It is also possible to use some common components in the sound generation such as amplifiers, for generating the high frequency communication signals and the lower frequency alarm type signal. A further benefit of the arrangement is that the control panel is provided with a microphone which is also used by the monitoring station during the two-way communication between the monitored space and the monitoring station.

As shown in FIG. 2, the combination unit also includes a door status detector 25 which senses the position of the door relative to the door frame. This device will cause the combination unit 8 to report a pre-alarmed condition to the control panel when the system is armed and the door is open. The user will then have a certain period of time to enter the proper code using the keypad 14. If the proper code is entered within a specified period of time, the signal is transmitted by the combination unit to the control panel. The control panel upon receipt of the signal terminates an alarm process. If the signal is not received within a certain period of time, the control panel 20 reports the alarm condition to the monitoring station 20.

The user in arming the system is forced through the normal security system procedure, such as entering a code at the keypad 14 and having the unit send a communication signal to the control panel 20 indicating that the system is to be armed. The control panel 20 can then transmit a confirmation signal to the combination unit. The combination unit upon receipt of the confirmation signal then goes through a arming sequence allowing the user a certain period of time to leave the premises and producing the prealarm audible signal.

Figure 3:
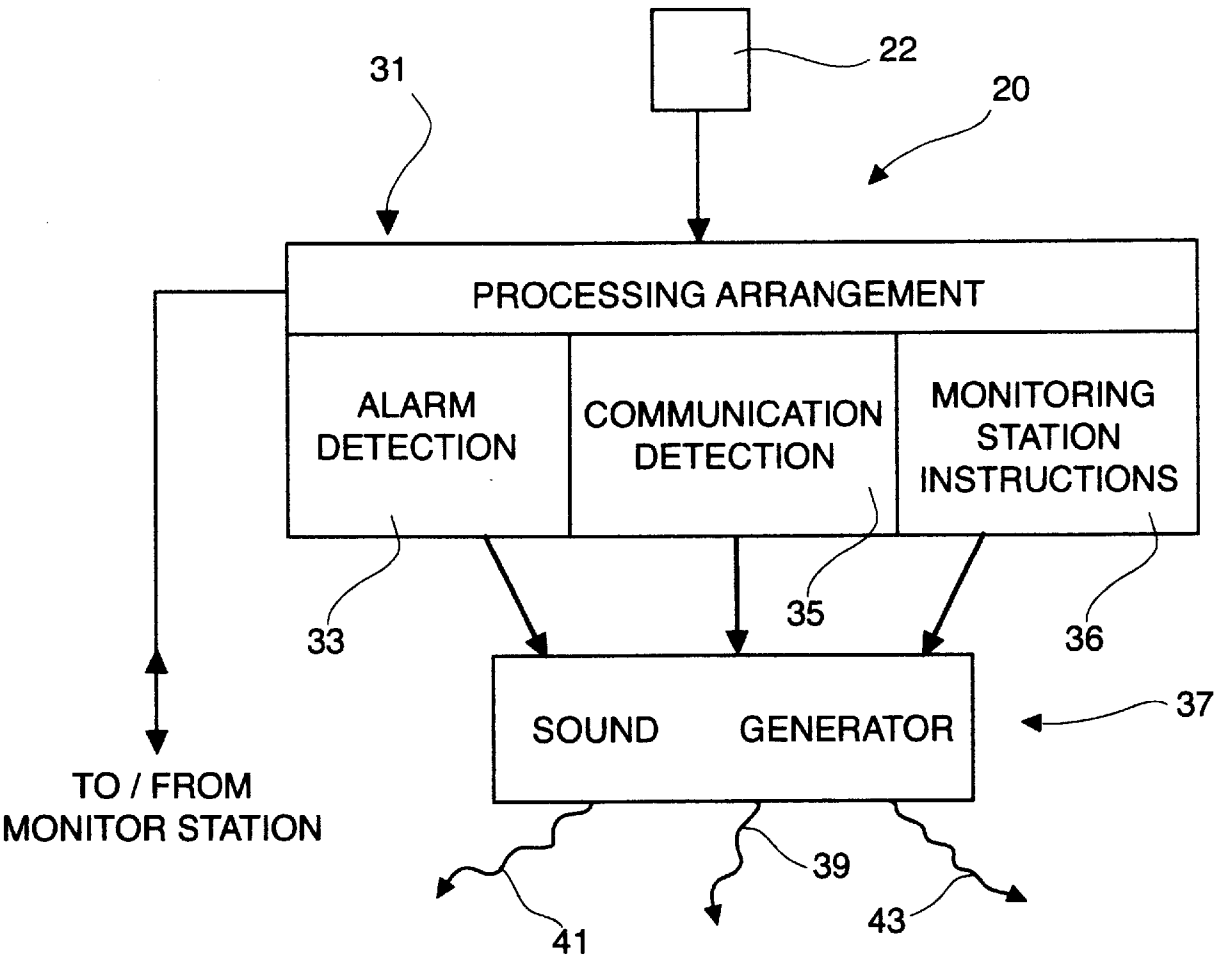
FIG. 3 illustrates the operation of the control panel.

FIG. 3 shows an overview of the operations of the control panel 20. The control panel 20 has the microphone 22 and the signal from this microphone is used to detect sound energy in the space being monitored. The signal from the microphone 22 is provided to the processing arrangement 31. The microphone receives signals 17 and 19 and also receives any other sound signals used as part of the two-way communication with the monitoring station. The processing arrangement 31 evaluates the signal from microphone 22 at 33 for an alarm event, such as a glass break event, intruder detection, etc. The signal from the microphone 22 is also evaluated at 35 for communication signals from the combination unit 8 or the detecting arrangement. The processing arrangement 31 also processes at 36 signals from the monitoring station to be reproduced by the sound generator 37 as part of the two-way communication with the monitored space during an alarm condition. The signal from the microphone is also provided to the monitoring station to complete the live two-way communication.

The sound generator 37 controlled by processing arrangement 31 can produce the alarm type signal 41, the communication signal 39 and the voice signal 43 from the monitoring station. Signal 39 is a high frequency signal at or near the upper end of the audible range.

Sound generator 37 can use piezoelectric transducers for generating signals 41 and 39 and can use a speaker for producing signal 43.

The present system using audible type signals received by microphones to provide two-way communication between a sensor and a control panel is cost effective and, surprisingly, is quite tolerant to ambient noise. In many cases, the monitored space is relatively quiet when the system is armed, as no one is present. Communication reliability is achieved by using a high frequency narrow bandwidth and repeating the signal several times for each transmission.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A security system for monitoring a space and reporting unauthorized entry, said security system comprising a control panel and a combination keypad and door sensor, said control panel including an arrangement connected to a telephone system for originating, a telephone communication with a monitoring station, said control panel including a microphone, a signal processing arrangement for the signal from said microphone, a microprocessor and a sound generating arrangement, said combination keypad and door sensor comprising a plurality of keys for entering codes into said keypad for arming and disarming of said system, a microphone, signal processing means for the signal of said microphone, a microprocessor and a sound generating arrangement, said control panel and said combination keypad and sensor using said sound generators and said microphones to form a high frequency free air broadcast communication link therebetween, said sound generator of said combination keypad and sensor producing as part of said communication link a communication signal in a high frequency and producing an audible signal portion for the user indicating a requirement to enter information via said keypad which information is communicated to said control panel by said combination key pad door sensor through said communication signal, whereby said control panel and said combination keypad and sensor interact to allow a user to arm and disarm the system at said combination keypad and sensor and have said instructions communicated to said control panel by the two-way free air broadcast communication signal therebetween.

2. A security system as claimed in claim 1 wherein said combination keypad and sensor also uses said microphone as part of a sensing arrangement for detecting other events in the space being monitored.

3. A security system as claimed in claim 2 wherein said microphone and sound generating arrangement of said control panel is used by said control panel as part of a two-way communication channel with said monitoring station when an alarm condition has been communicated to said monitoring station.

4. A security system as claimed in claim 3 wherein control panel also processes the signal of its microphone for signals indicative of an alarm condition in the monitored space and thereby acts as a further sensor of said system.

5. A security system as claimed in claim 1 wherein said control panel also processes the signal of its microphone for signals indicative of an alarm condition in the monitored space and thereby acts as a further sensor of said system.

6. A security system as claimed in claim 1 wherein said high frequency communication signal is at a frequency in the upper audible range.

7. A security system as claimed in claim 1 wherein said high frequency communication signal is at a frequency of about 20,000 kHz.

8. A security system as claimed in claim 1 wherein each of said control panel and said combination keypad and sensor include a filter arrangement for partially processing the signals produced by the respective microphones as part of the processing to obtain the communication signal.

* * * * *